US008595960B2

(12) United States Patent
Grange

(10) Patent No.: US 8,595,960 B2
(45) Date of Patent: Dec. 3, 2013

(54) GARMENT ROLLER PRESS

(76) Inventor: Jonathan Grange, Chelmsford, MA (US)

( * ) Notice: Subject to any disclaimer, the term of this patent is extended or adjusted under 35 U.S.C. 154(b) by 82 days.

(21) Appl. No.: 13/299,916

(22) Filed: Nov. 18, 2011

(65) Prior Publication Data

US 2012/0222337 A1 Sep. 6, 2012

Related U.S. Application Data

(60) Provisional application No. 61/447,955, filed on Mar. 1, 2011.

(51) Int. Cl.
*D06F 61/02* (2006.01)
*D06F 61/00* (2006.01)

(52) U.S. Cl.
USPC ..... 38/101

(58) Field of Classification Search
USPC ..... 38/74, 76, 77.1, 88, 100, 101; 219/245, 219/250, 254, 255
See application file for complete search history.

(56) References Cited

U.S. PATENT DOCUMENTS 834,742 A * 10/1906 Richardson ..... 138/163
1,192,518 A * 7/1916 Hammond ..... 38/101
1,271,577 A * 7/1918 Jeannetaud ..... 38/101
2,146,471 A * 2/1939 Hebert ..... 38/82
2,437,770 A * 3/1948 Van Olden ..... 219/231
2,940,650 A * 6/1960 Hirata ..... 223/96
3,287,542 A * 11/1966 Weitzner ..... 219/244
3,703,042 A * 11/1972 Smith ..... 38/69
3,742,630 A 7/1973 Camarco
4,075,458 A 2/1978 Moyer
4,177,908 A 12/1979 Batts
4,219,724 A 8/1980 Allvin
7,121,024 B1 10/2006 Clevenberg

* cited by examiner

*Primary Examiner* — Ismael Izaguirre
(74) *Attorney, Agent, or Firm* — Daniel Boudwin

(57) ABSTRACT

A convenient wrinkle removing device that employs a pair of rollers to press unsightly and undesirable wrinkles from an article of clothing while in a hanging position. The device comprises a pair of rollers attached to a frame, the frame having a handle for the user to grip. A suspended garment is inserted between the rollers, which are capable of translation and free rotation. The rollers lock into an operating position, compressing the garment therebetween while still maintaining their free rotation. This operating position enables the device to press the garment as it is fed therethrough. A user passes the article of clothing through the rollers, wherein the device flattens and removes wrinkles that may exist in the fabric of the garment. A heating element may be provided to improve the pressing operation, while clips are provided to control the garment as it is being pressed.

12 Claims, 3 Drawing Sheets

GARMENT ROLLER PRESS

CROSS REFERENCE TO RELATED APPLICATION

This application claims the benefit of U.S. Provisional Application No. 61/447,955 filed on Mar. 1, 2011, entitled "Typewriter Hanger."

BACKGROUND OF THE INVENTION

1. Field of the Invention

The present invention relates to a device for removing wrinkles from clothing using a means that is easy to use in the home or while traveling. More specifically, the present invention achieves wrinkle removal by utilizing a system of rollers to press the wrinkles out of the clothing fabric that is suspended from a clothing hanger. A frame with rotating rollers press the garment as it is fed between the rollers, while a heating element may also be incorporated for the purpose of heat pressing the garment.

2. Description of the Prior Art

A common problem that occurs when laundry is completed in the home is that the clean clothing becomes wrinkled. Clothes may become wrinkled for many reasons, such as the dryer is too densely packed with clothing during the drying process, or dried clothes may be left in the dryer for too long after the drying process has completed. Wrinkles in clothing can be unsightly and undesirable. Conversely, some creases and folds in clothing are highly desirable. For example, many individuals enjoy the look associated with pronounced creases in their dress clothing, for example creases down the sleeves of dress shirts, or a pleat down the front of a pair of slacks. Ironing clothing is effective for removing unsightly wrinkles, and adding desirable creases, but is a very time consuming process. Many individuals opt to have their dress clothes professionally laundered and pressed, instead of ironing the garments themselves, but this service can be expensive, especially if an individual has many garments in need of ironing.

Another common cause of wrinkled clothing is brought about during travel, wherein clothing is condensed into a travel suitcase or similar container, and then subsequently removed once at a destination or upon wearing the garment. The packaging during transit can result in unsightly wrinkles, which may be difficult to remove while away from the home. A need therefore arises for an alternate ironing or garment pressing means, and one that is easily adapted for home use or traveling use. The present invention provides a device that is handheld and requires no backing surface for support of the pressing operation. The device operates on a suspended garment, which is operable in a variety of settings. Several patents have been granted to devices that attempt to provide a means of removing wrinkles from clothing by ironing the wrinkles away in a similar fashion; however these devices have several known drawbacks that are discussed herein.

For example, U.S. Pat. No. 3,742,630 to Camarco describes a hand-held rolling iron. The iron is a cylinder roller with a handle end and a pointed non-graspable end that is tapered into a conical point extending outward from the cylindrical iron. A handle is attached to the handle end of the cylindrical rolling iron, which wraps around the rolling iron and extends parallel to the cylindrical rolling iron to the mid-point of the cylinder rolling iron. At the mid-point of the iron, the handle makes a ninety degree turn outwards away from the rolling iron, forming the portion of the handle that the user will hold the device by. To use the device, an individual places an article of clothing onto an ironing board, or other suitable surface for ironing thereupon, and gently rolls the iron across the surface of the clothing. A user can use the device to iron desirable creases into the article of clothing. The user can also use the conical shaped end of the rolling iron to smooth out smaller and harder to reach areas of the garment that the cylindrical rolling iron cannot properly press.

U.S. Pat. No. 7,121,024 to Clevenberg describes a handheld steam ironing device for removing wrinkles from clothing. The device is rectangular-shaped, featuring two flat members set close together yet maintaining a space between them. With regard to the rectangular shape of the device, the two members are connected together at one end of the device; they are connected together via a hinge, on one of the shorter sides of the rectangular. The top of the device features a handle for holding the device and several knobs and buttons, which regulate the temperature of the iron and the amount of steam the device will emit. Either one or both of the members are capable of functioning as an iron. The ironing capable side of each member faces the center space between the two members. When using the device, an individual chooses the desired thermal settings of the iron and how much steam to use by manipulating knobs located on the top of the device. A user then places the clothing, the sleeve of a shirt for example, in the space between the two members and slowly moves the device down the length of the sleeve to steam and iron the shirt sleeve in one fluid motion. The Clevenberg device can also be opened at the hinge so that the two members that were sandwiched together are converted into an ironing and steaming wand.

U.S. Pat. No. 4,219,724 to Allvin describes a clamping iron for removing wrinkles from clothing. The device features a gripping handle, a clamping lever, and two triangular-shaped jaws which can be clamped together by a user. The top jaw of the device is pyramid shaped and serves as the housing unit for the heating coil and thermal controls for regulating the temperature of the iron. The bottom jaw is a flat metal plate. The two triangular jaws clamp together when the user depresses the clamping lever into the gripping handle. A user would place an article of clothing in between the two triangular jaws and clamp the device shut onto the fabric to iron the clamped area of fabric.

The Camarco, Clevenberg and Allvin devices all share a common drawback. To use each device, a user must lay out an article of clothing and then move the ironing device over the whole article to remove wrinkles therefrom. The processes for using each of the Camarco, Clevenberg and Allvin devices are not necessarily an improvement over traditional ironing methods. A user must still take the time to lay out the article of clothing for ironing and must manipulate the garment during the ironing process, including flipping the article over as to ensure the backside of the garment is also ironed to satisfaction. The ironing process is time consuming; a user must painstakingly iron each garment one item at a time. A third party ironing surface is also required for some of these devices, which is limiting to its usefulness in certain circumstances. One embodiment of the present invention enables a user to press an article quickly and effectively while in a hanging position, without the need for a support surface. By employing a system of rollers, which may alternatively incorporate a heating element, a user can quickly iron an article of clothing while pressing the garment between the rollers. Use of the present invention reduces the amount of time an individual must spend ironing his or her clothing, and likewise allows a user to press a garment in a wide variety of situations, particularly wherein an ironing support surface or the time consuming process of traditional ironing methods are not appropriate or possible.

Prior art patents exist for heating elements for use in applications beyond merely ironing wrinkles from clothing articles. For example, heating elements have been used for styling hair. U.S. Pat. No. 4,075,458 to Moyer describes a compactable hair curling iron device which can be folded in upon itself for easy and convenient storage. The primary function of the device is for use when curling hair, which is the process of creating artificial structure and style in an individual's hair that is not necessarily naturally occurring. The Moyer device has a curling iron member that is connected to a pivot joint. Also connected to the pivot point is a concave shield that also serves as the curling iron handle when the device is in the open configuration. When the device is in the open configuration it is functional and can be used for the purpose of curling hair. When the device is in the closed, compact configuration it can easily be stored in a purse or backpack.

Looking to a different aspect of the present invention—the locking mechanism that governs when the system of rollers is in the operating position, or the non-operating position—U.S. Pat. No. 4,177,908 to Batts describes a pant hanging device comprising a pairing of bars which latch together, pressing between the two bars a pair of pants. The bars are hinged together at one end, and have a latching mechanism at the other end, which a user would manipulate to lock the two bars together in a closed configuration. When the device is in an open configuration, a user can loop a pair of pants over the first bar then latch the second bar in place to the first, securing the pair of pants in place on the hanging device. The hanging device has a support hook connected to the center of one of the bars for hanging the device. A user would typically store the device in a closet, but a user could hang the device on a nail or shower curtain rod is so desired. The Batts device fails to disclose the elements of the present invention, including the mechanism for pressing articles of clothing or its method of operation.

The present invention provides a device that employs two parallel rollers that are used to press and roll a garment, removing unwanted wrinkles therefrom. The device is handheld and operable with a garment in a hanging position, requiring no support surface. It is capable of presses both sides of a garment simultaneously, reducing the time and effort required to iron each side individually. It is therefore submitted that the present invention substantially diverges in design elements from the prior art and consequently it is clear that there is a need in the art for an improvement to existing clothing roller devices. In this regard the instant invention substantially fulfills these needs.

SUMMARY OF THE INVENTION

In view of the foregoing disadvantages inherent in the known types of clothing wrinkle removing devices now present in the prior art, the present invention provides a new means of removing unsightly wrinkles from articles of clothing wherein the same can be utilized for providing convenience for the user when removing wrinkles from an article of clothing is required and traditional methods are not appropriate or preferred.

It is therefore an object of the present invention to provide a new and improved means of removing wrinkles form clothing by utilizing a roller device that has all of the advantages of the prior art and none of the disadvantages.

Another object of the present invention is to provide a means of removing wrinkles from an article of clothing without applying heat to the garment and risking damage to the fabric, if so desired by the user.

Another object of the present invention is to provide a means of pressing an article of clothing without a support surface, and while the garment is suspended in a hanging position.

Another object of the present invention is to provide a means of removing wrinkles from an article of clothing that can be utilized while traveling, wherein traditional means of ironing or professionally pressing garments may not be feasible.

Yet another object of the present invention is to provide the user with a means of removing wrinkles that includes a thermal heating means, ironing wrinkles from the garment as they are pressed by the rollers.

A final object of the present invention to provide a wrinkle removing device that is cost effective, convenient and easy to use.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
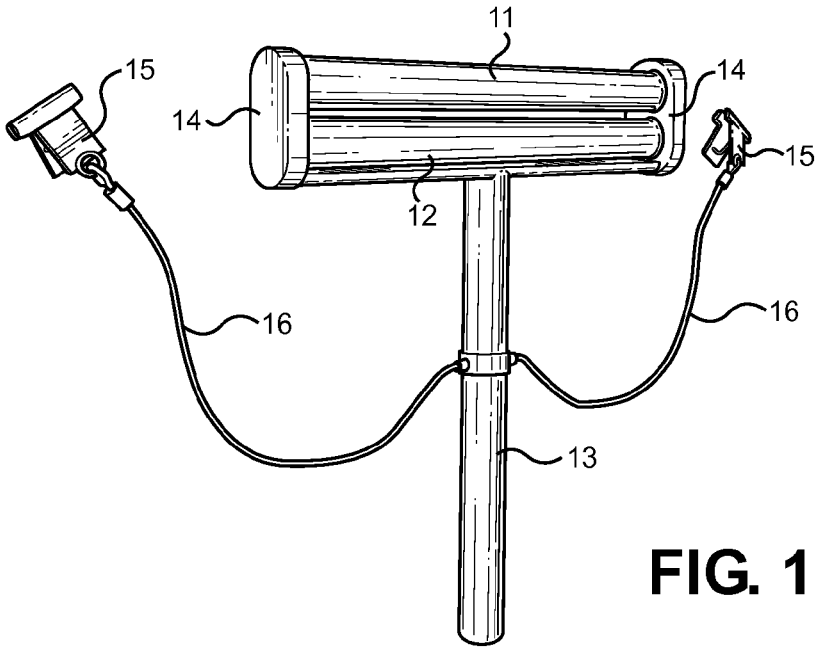
FIG. 1 is a perspective view of the present invention when the device is not in use.

Reference is made herein to the attached drawings. Like reference numerals are used throughout the drawings to depict like or similar elements of the garment wrinkle removing device. For the purposes of presenting a brief and clear description of the present invention, the preferred embodiment will be discussed as used for removing wrinkles from a hanging garment by means of a handheld roller press. The figures are intended for representative purposes only and should not be considered to be limiting in any respect.

Referring now to FIG. 1, there is shown a perspective view of an embodiment of the clothing wrinkle removing device as described by the present invention. This embodiment comprises a handheld frame having a first and second connected end 14, along with two cylindrical rollers 11, 12 supported by the frame connected ends, which are set in close proximity to one another and are free to rotate within the frame. There is an outer roller 11 located furthest from the frame handle 13 and an inner roller 12 mounted closer to the frame handle 13. The rollers are rotatably held in position at their terminal ends by the frame 14 and are positioned in a specific proximity to one another to provide a gap to feed a garment through. The roller frame 14 extends downward to form a handle 13 that converges at the roller midsection to form a gripping handle 13 for the user, extends outward from the rollers.

The device also comprises a plurality of clips 15 attached by cords 16 to the handle of the device 13. The clips 16 are designed to clip onto the article of clothing. In the case of a dress shirt, a clip would be attached to the cuff of each sleeve prior to utilizing the device to press the garment. The can be used to prevent certain portions of the garment from entering the rollers. The cords 16 may also be rigid rods, allowing portions of the garment to be held in position while being pressed.

Figure 2:
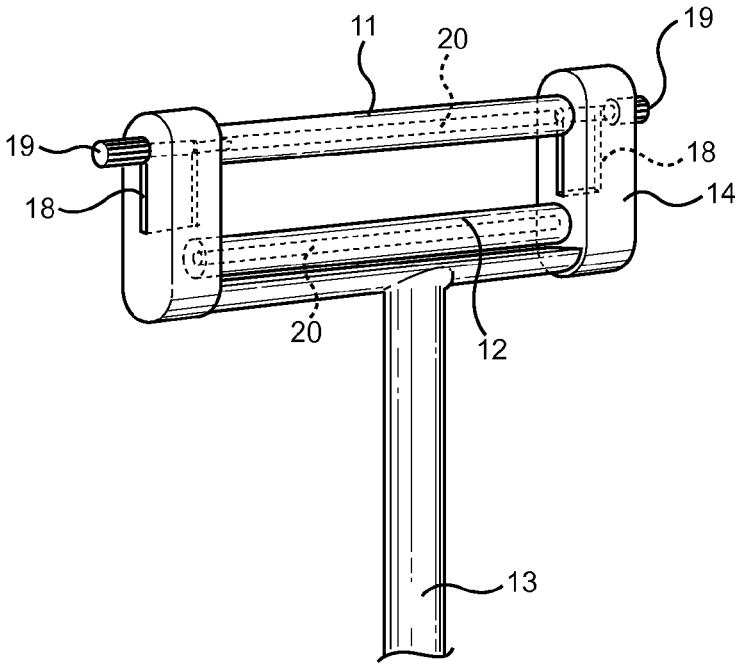
FIG. 2 is a perspective view of the present invention with the sliding channels and locking screws visible, along with the heating coil.

Referring now to FIG. 2, there is shown a second embodiment of the present invention, wherein the gap between rollers is adjustable and a heating means is provided for improved wrinkle removal. The first embodiment comprises rollers that are free to rotate but are locked in a predetermined location with regard to one another. The second embodiment comprises a channel and locking means for which to adjust the proximity of the two rollers prior to their use. The roller frame 14 rotatably supports the rollers 11, 12 within a sliding channel 18, which provides adjustment of the upper roller 11 position and determines a gap through which a garment is fed. To achieve the operating position of the top roller 11, wherein the gap between rollers is ideally suited for pressing wrinkles from a garment, a user releases a locking screw 19 on either side of the frame, which releases the top roller 11 within the channel 18 and permits it to slide freely therein. Once positioned, the user may reapply the locking screw 19 to secure the top roller 11 position. When locked in place, the top roller 11 is free to rotate but is locked into a position in proximity to the bottom roller 12 that may be more ideally suited for a specific garment, wherein one garment may be thinner or thicker than the next. The need for reduced proximity in the operating position is apparent, as the top roller 11 and the bottom roller 12 will press an article of clothing tightly therebetween, removing the wrinkles from the garment as it passes through. To release the article of clothing, and achieve the non-operating position, a user would release the sliding lock 19 and reposition the roller to provide an increased gap between the two rollers.

It is further contemplated to provide a thermal heating means within the body of one or both rollers 11, 12. As shown in FIG. 2, a heating coil 20 is provided within the interior of each roller. The heating coil is an electrically conductive member that transfers heat through electrical resistance, which allows heat to enter the roller and improve the wrinkle removal process while pressing a garment. This embodiment of the rollers requires internal wiring and a power source, which is preferably an A/C power cord routed through the handle 13 of the device and placed in connection with an A/C outlet. The material of the roller, in this embodiment, is ideally a thermally conductive material such as a metallic or similar material.

Figure 3:
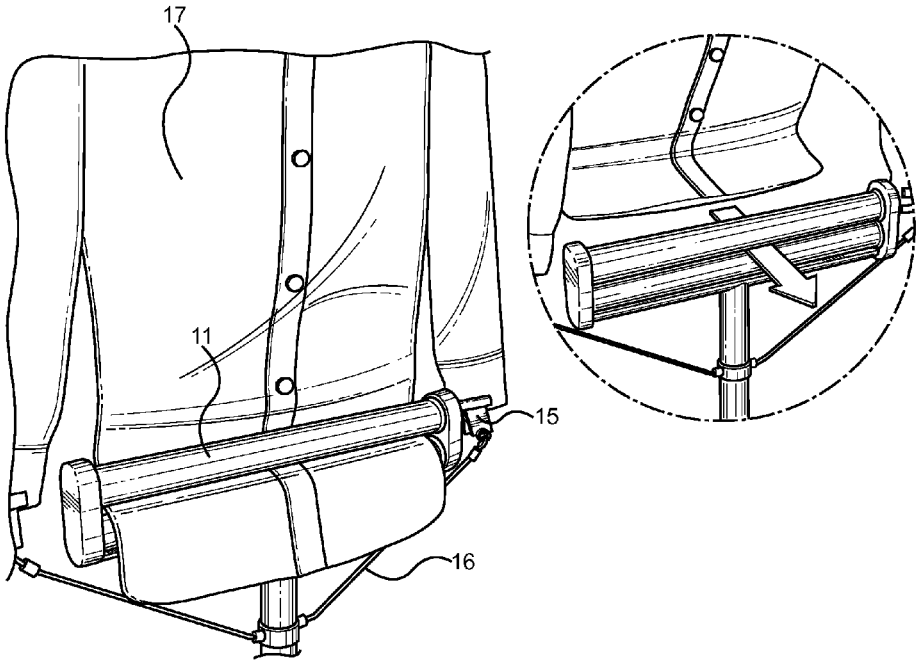
FIG. 3 is a perspective view of the device when the device is attached to a shirt with a magnified view of how to put a shirt into the device

Referring now to FIG. 3, there is shown a perspective view of the present invention being utilized to remove wrinkles from a shirt 17, with an exploded view of the shirt insertion into the device. To use the present invention, a user inserts the shirt tail 17 in between the two rollers. In the first embodiment of the present invention, a user inserts an article of clothing into the space between the two rollers and feeds the shirt through the rollers, moving the device up the length of the garment to press out wrinkles in the shirt along the way. The shirt is held in position via a hanger, or similar device to suspend the garment and allow the roller to operate. Wrinkle release or similar product may be used in this embodiment. In the second embodiment, the gap between rollers is adjustable and a heating means within the rollers may be used to release wrinkles. The gap between rollers can be reduces to a degree that the garment is compressed therebetween, while the heated rollers flat any unwanted wrinkles. Clips 15 attached to the handle of the device may be utilized to keep portions of the garment away from the device during operation, as desired by the user.

Figure 4:
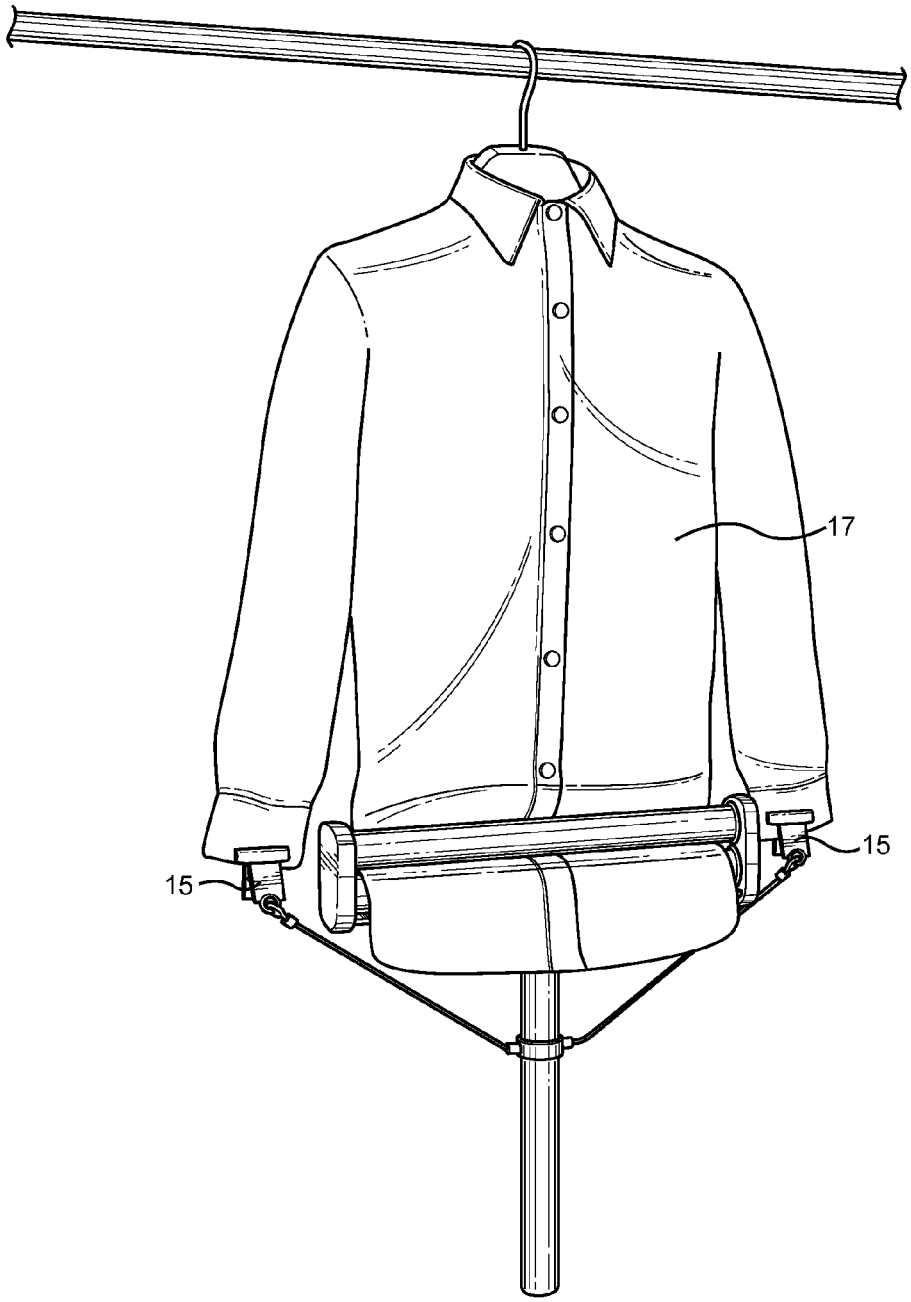
FIG. 4 is a perspective view of the device being stored on a shirt.

Referring now to FIG. 4, there is shown a perspective view of the present invention being stored on a hanging shirt 17. When not in use, the present invention can be stored on a shirt by connecting the clips 15 to the sleeves of a garment, and fixing the device onto a garment's shirt tails 17 by locking the rotating roller in the operating position. By not feeding the garment through the device, the device will stay locked in place. A garment with the device attached to it, but not in use, can be hung in a closet for storage.

The present invention provides a convenient and cost effective wrinkle removing device that employs a system of rollers for the purpose of pressing unsightly and undesirable wrinkles out of an article of clothing. The device may incorporate a heating element and a means to adjust the position of the rollers such that a user may iron while pressing the article of clothing. The device is adapted for use within a residence or while traveling away from home. Its compact shape and simple design increase its versatility. In the first embodiment, the device requires no electrical power and incorporates very few moving parts. The second embodiment includes greater features and may provide improved operation at the cost of complexity.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrinkle removing device for suspended garments of clothing, comprising:

a frame having a first and second connected end, an inner and outer cylindrical roller, said frame rotatably supporting said rollers at said connected ends;

said rollers being positioned in proximity to create a gap through which to feed a garment therethrough;

a gripping handle connected to said frame between said first and second connected end;

said frame further comprises a pair of channels within said connected ends for which to slideably position said outer roller with respect to said inner roller, said outer roller being held within the channel in a static position by a locking means.

2. The device of claim 1, wherein said locking means comprises a turn screw in each channel to secure said outer roller in place within said channel.

3. The device of claim 1, further comprising a heating element in at least one roller.

4. The device of claim 1, further comprising a pair of clips that are connected to said handle for supporting a portion of said garment.

5. The device of claim 4, wherein said clips are supported by cords.

6. The device of claim 4, wherein said clips are supported by rigid rods.

7. A wrinkle removing device for suspended garments of clothing, comprising:

a frame having a first and second connected end, an inner and outer cylindrical roller, said frame rotatably supporting said rollers at said connected ends;

said rollers being positioned in proximity to create a gap through which to feed a garment therethrough;

a gripping handle connected to said frame between said first and second connected end;

a pair of clips that are connected to said handle for supporting a portion of said garment.

8. The device of claim 7, wherein said frame further comprises a pair of channels within said connected ends for which to slideably position said outer roller with respect to said inner roller, said outer roller being held within the channel in a static position by a locking means.

9. The device of claim 8, wherein said locking means comprises a turn screw in each channel to secure said outer roller in place within said channel.

10. The device of claim 8, further comprising a heating element in at least one roller.

11. The device of claim 8, wherein said clips are supported by cords.

12. The device of claim 8, wherein said clips are supported by rigid rods.

* * * * *